US006872169B2

(12) United States Patent
Kuo

(10) Patent No.: US 6,872,169 B2
(45) Date of Patent: Mar. 29, 2005

(54) TREADMILL HAVING TREADMILL FRAME ADJUSTING DEVICE

(76) Inventor: Hai Pin Kuo, No. 15, Lane 833, Wen Hsien Road, Tainan (TW), 704

( * ) Notice: Subject to any disclaimer, the term of this patent is extended or adjusted under 35 U.S.C. 154(b) by 242 days.

(21) Appl. No.: 10/356,979

(22) Filed: Feb. 3, 2003

(65) Prior Publication Data

US 2004/0152564 A1 Aug. 5, 2004

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,782,723 A 7/1998 Kuo ..... 482/54
6,171,216 B1 * 1/2001 Wang et al. ..... 482/54
6,592,496 B1 * 7/2003 Tsou ..... 482/54
6,726,602 B2 * 4/2004 Chang ..... 482/54

* cited by examiner

*Primary Examiner*—Justine R. Yu
*Assistant Examiner*—Tam Nguyen
(74) *Attorney, Agent, or Firm*—Charles E. Baxley

(57) ABSTRACT

A treadmill includes a treadmill frame and a lever having front portions pivotally secured to a base, and foldable or rotatable up and down between upward folding position and downward working position. A leg is pivotally secured between rear portions of the treadmill frame and the rear portion of the lever, to form a quadrilateral structure together with the treadmill frame and the lever. A driving device is coupled between the leg and the treadmill frame, to force the leg to rotate relative to the treadmill frame and the lever, and thus to rotate the treadmill frame and the lever relative to the base between upward folding position and downward working position.

6 Claims, 6 Drawing Sheets

TREADMILL HAVING TREADMILL FRAME ADJUSTING DEVICE

BACKGROUND OF THE INVENTION

1. Field of the Invention

The present invention relates to a treadmill, and more particularly to a treadmill including an adjusting device for adjusting treadmill frame up and down to different inclinations, and for allowing the treadmill frame to be foldable up to an upward folding position.

2. Description of the Prior Art

Typical treadmills have been widely used today, for allowing users to conduct walking or jogging exercisers at home. However, the typical treadmills comprise a large size or volume that occupy a large floor space. Accordingly, various kinds of typical treadmills have been developed to include various kinds of foldable or collapsible configurations, in order to reduce the occupied area or volume of the treadmills in the housing buildings.

For example, some of the typical treadmills comprise a foldable configuration for allowing the treadmill frame to be folded upwardly to a folding position, and downwardly to a working position, with such as pneumatic or hydraulic cylinders or actuators, or by motor-driving-mechanisms. For example, U.S. Pat. No. 5,782,723 to the present inventor, Kuo, also discloses a similar treadmill having a treadmill frame that may only be adjusted up and down between a folding position and a working position.

However, the treadmill frames of these typical treadmills may only be folded up and down between the upwardly folding position and downwardly working position only, and may not be adjusted to or supported at different inclinations or elevations.

For example, when the treadmill frame is supported in a substantially horizontal position, the users may conduct typical walking or jogging operations with the treadmill. When the treadmill frame is adjusted to or supported at an inclination having a higher rear portion and a lower front portion, the users may easily conduct walking or jogging operations similar to walk or jog downhill.

On the contrary, when the treadmill frame is adjusted to or supported at an inclination having a higher front portion and a lower rear portion, the users may have to spend more energy to conduct walking or jogging operations similar to walk or jog uphill. However, the treadmill frames of the typical treadmills may only be adjusted to different inclinations, and may not be folded up and down between the upwardly folding position and downwardly working position.

The present invention has arisen to mitigate and/or obviate the afore-described disadvantages of the conventional treadmills.

SUMMARY OF THE INVENTION

The primary objective of the present invention is to provide a treadmill including an adjusting device for adjusting a treadmill frame up and down between different inclinations, and for allowing users to conduct various kinds of walking or jogging exercises.

The other objective of the present invention is to provide a treadmill including an adjusting device for allowing the treadmill to be easily folded between an upwardly folding position and a downwardly working position.

The further objective of the present invention is to provide a treadmill including a greatly simplified adjusting device for allowing the treadmill to be easily manufactured and assembled with greatly lowered cost.

In accordance with one aspect of the invention, there is provided a treadmill comprising a base, a treadmill frame including a front portion pivotally secured to the base with a pivot axle, and including a rear portion, a lever including a front portion pivotally secured to the base with a pivot pin, and including a rear portion, a leg including two ends pivotally secured between the rear portion of the treadmill frame and the rear portion of the lever, to form a quadrilateral structure together with the treadmill frame and the lever. A driving device may further be provided to drive or force the leg to rotate relative to the treadmill frame and the lever, and to rotate the treadmill frame and the lever relative to the base between upward folding position and downward working position. The treadmill may thus include a greatly simplified configuration or structure for allowing the treadmill frame to be easily folded between the upward folding position and the downward working position, and may thus be easily manufactured and assembled with greatly reduced cost.

The leg includes a first end pivotally secured to the rear portion of the treadmill frame with a pivot pin, and a second end pivotally secured to the rear portion of the lever with a pivot rod. The rear portion of the lever includes an oblong hole formed therein to slidably receive the pivot rod of the leg.

The driving device includes a tube attached to a middle portion of the treadmill frame, and an extension slidably engaged in the tube and having a free end pivotally secured to the leg, to force the leg toward and away from the treadmill frame when the extension is slid relative to the tube. The treadmill frame further includes a beam secured to the leg, the free end of the extension is pivotally secured to the leg with a pivot pin.

The leg may also be rotated relative to the treadmill frame, to adjust the leg relative to the treadmill frame to different angular positions, and thus to adjust the treadmill frame relative to the supporting surface or ground to different inclinations. The leg includes a wheel rotatably secured to the second end thereof, to engage with a supporting surface.

The rear portion of the lever includes an oblong hole formed therein, the second end of the leg includes a pivot rod slidably received in the oblong hole of the lever.

The driving device includes a tube attached to a middle portion of the treadmill frame, and an extension slidably engaged in the tube and having a free end pivotally secured to the leg, to force the leg toward and away from the treadmill frame when the extension is slid relative to the tube. The driving device may either be a pneumatic or hydraulic cylinder or actuator, or a motor-driving-mechanism, to move or to adjust the extension relative to the tube, in order to move the leg relative to the treadmill frame, and thus to fold or to rotate the treadmill frame and the lever relative to the base between the upward folding position and the downward working position. In accordance with the other aspect of the invention, there is provided a method to fold a treadmill frame between an upward folding position and a downward working position, comprising pivotally attaching a front portion of a treadmill frame to a base with a pivot axle, pivotally attaching a front portion of a lever to a base with a pivot axle, pivotally attaching a leg between a rear portion of the treadmill frame and a rear portion of the lever, to form a quadrilateral structure together with the treadmill frame and the lever, and forcing the leg to rotate relative to the treadmill frame and the lever, to fold and to rotate the treadmill frame and the lever relative to the base between upward folding position and downward working position.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
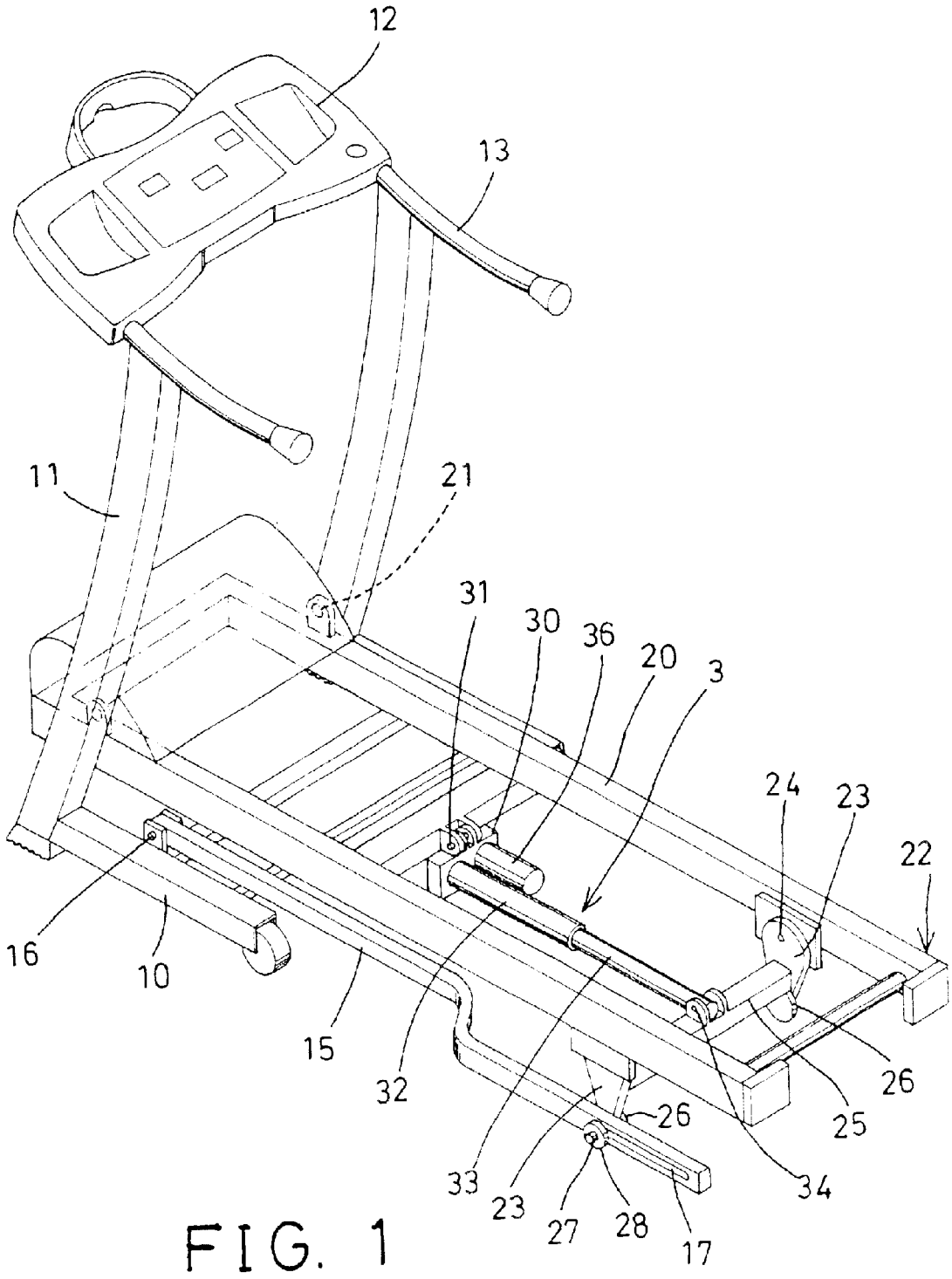
FIG. 1 is a perspective view of a treadmill in accordance with the present invention, in which the treadmill frame is folded downwardly to a downward working position.
Figure 2:
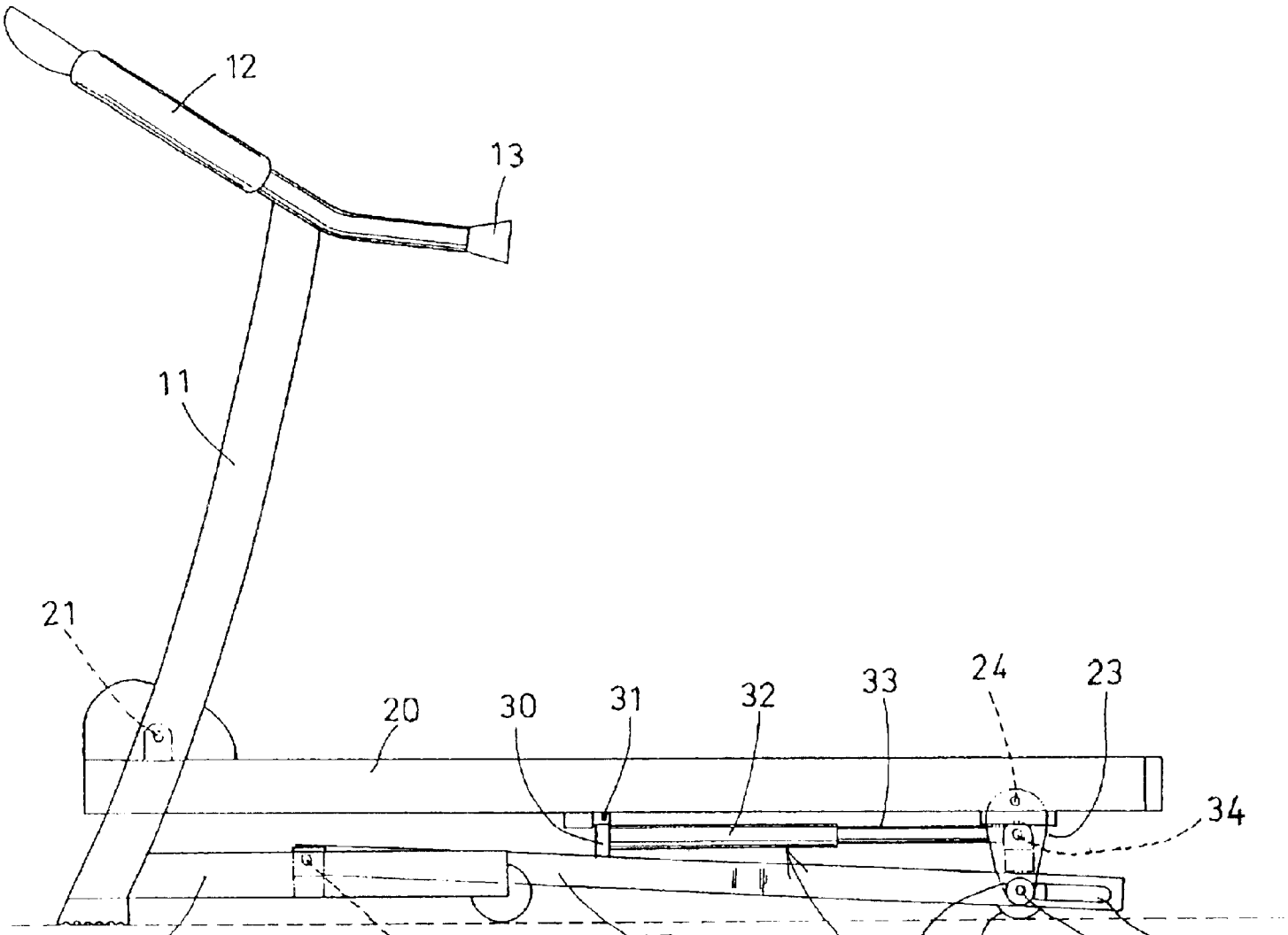
FIG. 2 is a side plan schematic view of the treadmill as shown in FIG. 1, in which the treadmill frame is also folded downwardly to the downward working position.

Referring to the drawings, and initially to FIGS. 1 and 2, a treadmill in accordance with the present invention comprises a base 10 including one or more, such as two posts 11 extended upwardly from the front portion thereof, and a control panel 12 and one or more handles 13 provided on top of the posts 11, for receiving various control elements, such as speedometer, etc., and for supporting the upper portion of the users.

Figure 3:
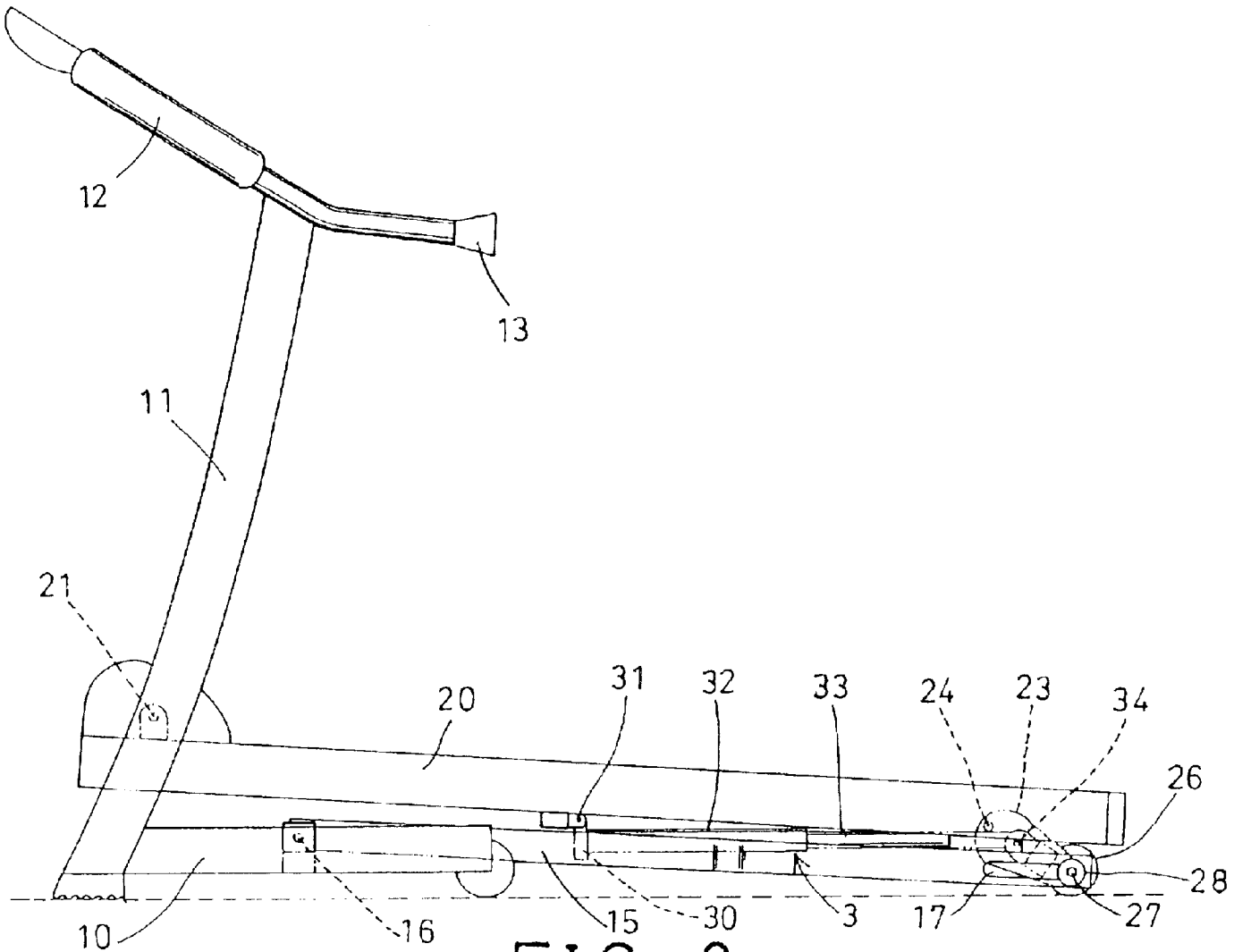
FIG. 3 is a side plan schematic view of the treadmill, similar to FIG. 2, in which the treadmill frame has been folded or adjusted to a working position having a different inclination, or having a much lower rear portion thereof.
Figure 4:
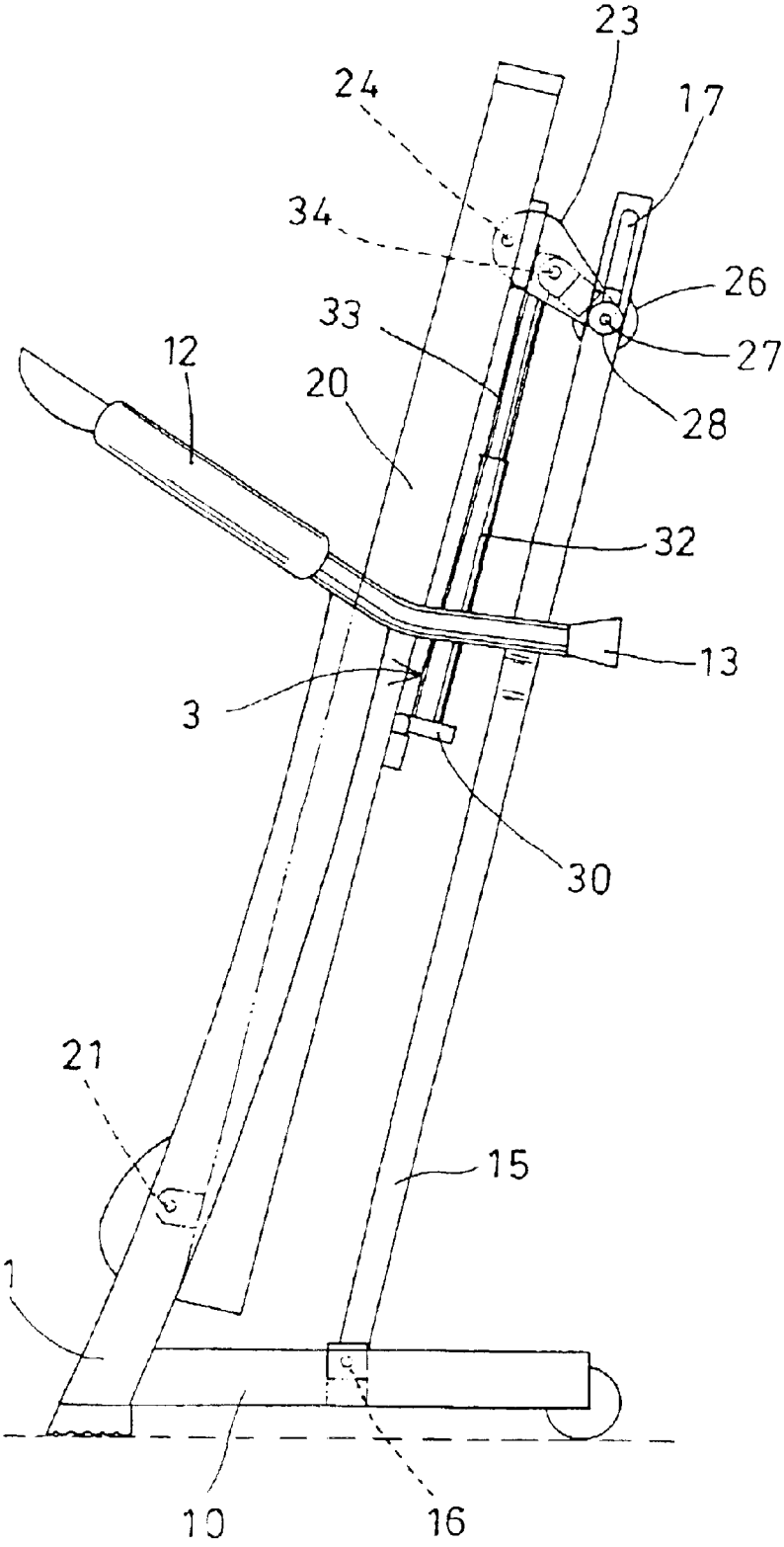
FIG. 4 is a side plan schematic view of the treadmill, similar to FIGS. 2 and 3, in which the treadmill frame has been folded or adjusted upwardly to an upward storing position.
Figure 5:
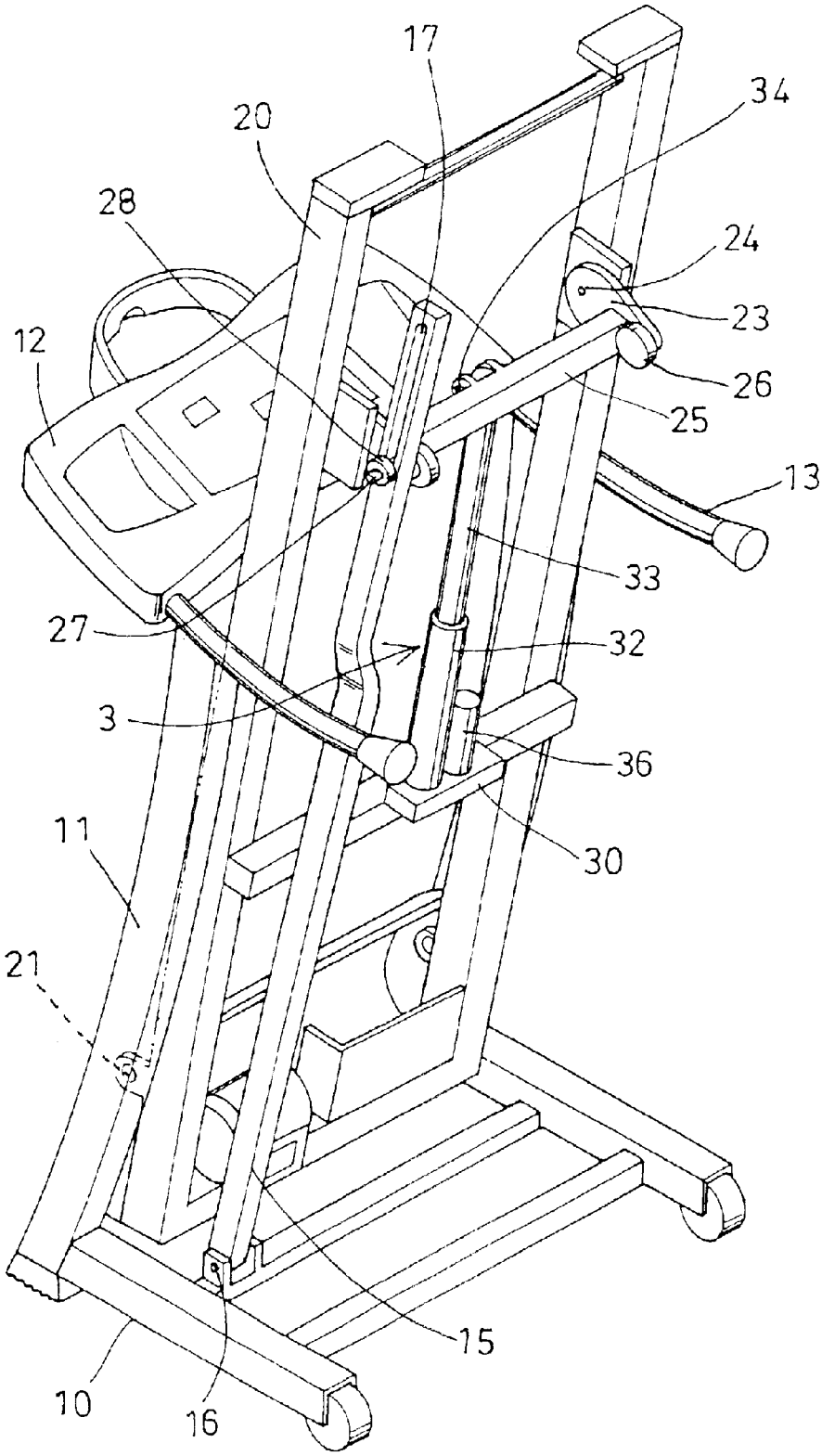
FIG. 5 is a perspective view of the treadmill as shown in FIG. 4, in which the treadmill frame has also been folded upwardly to the upward storing position.

A treadmill frame 20 includes a front portion pivotally or rotatably secured to the base 10, such as to the posts 11 of the base 10 with a pivot axle 21, for allowing the treadmill frame 20 to be folded or rotated relative to the base 10, as shown in FIGS. 1–5, and for allowing the treadmill frame 20 to be folded or rotated upwardly relative to the base 10 to an upwardly folding position as shown in FIGS. 4, 5, and to be folded or rotated downwardly relative to the base 10 to a downwardly working position as shown in FIGS. 1–3.

The treadmill frame 20 normally includes an endless tread belt (not shown) rotatably engaged or supported thereon, and driven by a motor device (not shown), and a tread board engaged in the endless tread belt, for supporting the users, and for allowing the users to conduct walking or jogging exercises on the endless tread belt. The configuration of the tread board, and the bread belt and the motor driving device is typical and will not be described in further details.

The treadmill frame 20 includes a distal rear end or free end 22 distal to the pivot shaft 21 and the posts 11, and one or more, such as two legs 23 pivotally or rotatably secured to the free end 22 of the treadmill frame 20 with pivot pins 24, for allowing the legs 23 to be rotated relative to the treadmill frame 20 to different angular positions, best shown in FIGS. 2–4, and thus for allowing the free end or rear end 22 of the treadmill frame 20 to be moved or adjusted up and down, and thus for allowing the treadmill frame to be adjusted to different inclinations relative to the supporting ground or surface.

It is preferable that a beam 25 is secured between the legs 23, for solidly coupling the legs 23 together, and for allowing the legs 23 to be moved simultaneously, or to be moved in concert relative to the treadmill frame 20 to different angular positions. One or more, such as two wheels 26 may further be provided and attached to the lower ends of the legs 23 respectively, for facilitating the movement, particularly the rotational movement of the legs 23 relative to the supporting surface or ground and thus relative to the treadmill frame 20. For example, the wheels 26 may each be rotatably attached to the lower ends of the legs 23 with a pivot rod 27 respectively.

A lever 15 may further be provided and may include a front end pivotally or rotatably secured to the base 10 with a pivot pin 16, for allowing the lever 15 to be rotated and adjusted up and down relative to the base 10 (FIGS. 2–4). The lever 15 includes a free end or a rear end having an oblong hole 17 formed therein, to slidably receive one of the pivot rods 27. A stop or a washer 28 may further be provided and attached to the pivot rod 27, to stably and slidably retain the pivot rod 27 within the oblong hole 17 of the lever 15, and to prevent the pivot rod 27 from being disengaged from the oblong hole 17 of the lever 15.

In operation, as shown in FIGS. 1–3, the pivot rod 27 is movable or adjustable along the oblong hole 17 of the lever 15, when the legs 23 are rotated or adjusted relative to the treadmill frame 20 to different angular positions, or when the free end or rear end 22 of the treadmill frame 20 is moved or adjusted up and down to different inclinations relative to the supporting ground or surface and relative to the base 10.

A driving device 3 is provided to rotate or to move the beam 25 and/or the legs 23 relative to the treadmill frame 20, and may be a pneumatic or hydraulic cylinder or actuator, or may be a motor-driving-mechanism. For example, the driving device 3 includes a seat 30 solidly secured to or rotatably secured to the middle portion of the treadmill frame 20 with a pivot joint 31, a tube 32 secured to the seat 30, and an extension or adjusting screw 33 slidably secured or threaded in the tube 32. The screw 33 includes a free end pivotally or rotatably secured to the legs 23 or beam 25 with a pivot pin 34.

In operation, when the adjusting screw 33 is threaded or moved relative to the tube 32, the legs 23 may be moved or rotated relative to the treadmill frame 20 by the movement of the adjusting screw 33 relative to the tube 22. A motor 36 may also be secured to the seat 30 and provided to drive or rotate the screw 33 relative to the tube 32, in order to move or adjust the screw 33 relative to the tube 32, and thus to rotate the legs 23 relative to the treadmill frame 20.

Alternatively, the member 36 may be used to supply pressurized air or hydraulic oil to the tube 32, in order to move the extension 33 out of the tube 32, and so as to rotate the legs 23 relative to the treadmill frame 20, such that the treadmill frame 20 may also be adjusted relative to the base 10 or the supporting surface or ground to different inclinations.

In operation, as shown in FIGS. 1 and 2, when the pivot rod 27 of the leg 23 is moved forward to the frontmost position of the oblong hole 17 of the lever 15, and when the legs 23 are further rotated or pulled or forced toward the seat 30 or the tube 32 or the middle portion of the treadmill frame 20, both the treadmill frame 20 and the lever 15 may be forced to move or to rotate upwardly toward the upward folding position as shown in FIGS. 4 and 5.

Figure 6:
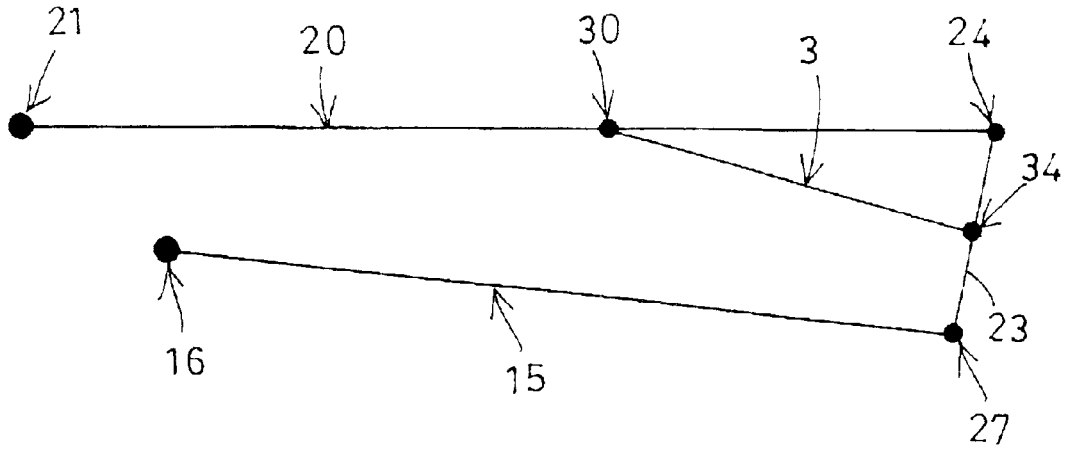
FIGS. 6 and 7 are schematic views showing the movements of various joints of the treadmill, for illustrating the operation of the treadmill.
Figure 7:
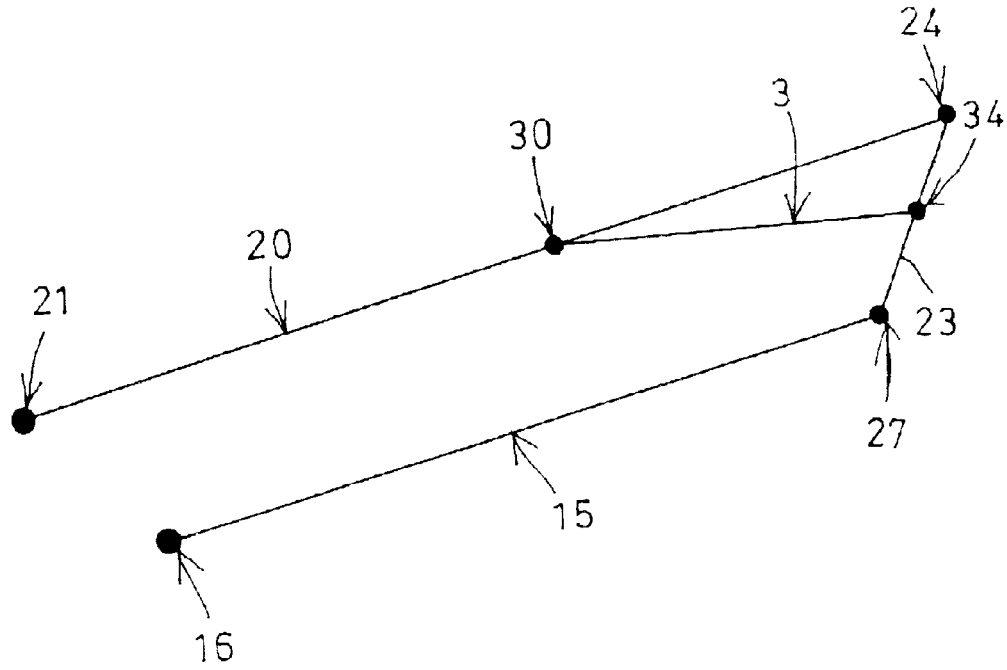

For example, as shown in FIGS. 6 and 7, the pivot pin 16 represents the pivotal or rotatable coupling of the front end of the lever 15 to the base 10. The pivot axle 21 represents the pivotal or rotatable coupling of the front end of the treadmill frame 20 to the base 10. The reference numeral "30" represents the middle portion of the treadmill frame 20 or the one end, such as the front end of the driving device 3, or the seat 30 of the driving device 3. The pivot pin 24 represents the pivotal or rotatable coupling of the legs 23 to the treadmill frame 20. The pivot pin 34 represents the pivotal or rotatable coupling of the other end, such as the rear end of the driving device 3 to the beam 25 or to the legs 23. The pivot rod 27 represents the lower end of the leg 23 that may be slid along the oblong hole 17 of the lever 15.

The distance between the seat 30 of the driving device 3 and the pivot axle 21, and the distance between the seat 30 of the driving device 3 and the pivot pin 24 of the leg 23 are predetermined or fixed, and may not be adjusted to different distances. Similarly, the distance between the pivot pin 34 of the driving device 3 and the pivot pin 24 of the leg 23, and the distance between the pivot pin 34 of the driving device 3 and the pivot rod 27 of the leg 23 are also predetermined or fixed, and may not be adjusted to different distances.

In addition, when the pivot rod 27 of the leg 23 is moved forward to the frontmost position of the oblong hole 17 of the lever 15, the distance between the pivot pin 16 of the lever 15 and the pivot rod 27 of the leg 23 will be predetermined or fixed, and may not be adjusted to different distances. At this moment, only the pivot pin 34 of the driving device 3 may be moved or forced toward the seat 30 of the driving device 3 by the movement or adjustment of the extension 33 relative to the tube 32, or the legs 23 or the beam 25 may be moved or forced toward the seat 30, such that both the treadmill frame 20 and the lever 15 may be forced to move or to rotate upwardly toward the upward folding position as shown in FIGS. 4 and 5.

It is to be noted that the driving device 3 may be used to move or to rotate the leg 23 relative to the treadmill frame 20, in order to adjust the treadmill frame 20 to different inclinations relative to the supporting ground or surface. Simultaneously, the driving device 3 may further be used to move or to force the pivot rod 27 of the leg 23 along the oblong hole 17 of the lever 15, and then to move or to force the leg 23 against the lever 15, in order to move or to rotate both the treadmill frame 20 and the lever 15 relative to the base 10, and upwardly toward the upward folding position as shown in FIGS. 4 and 5.

It is further to be noted that the leg 23 may thus be formed as a pivot leg 23 between the free ends of the treadmill frame 20 and the lever 15, so as to form a quadrilateral structure together with the treadmill frame 20 and the lever 15. The adjustable driving device 3 may then be coupled between the pivotal leg 23 and the treadmill frame 20 to move or to rotate the pivotal leg 23 toward the treadmill frame 20, and thus to move or to rotate both the treadmill frame 20 and the lever 15 relative to the base 10, and upwardly toward the upward folding position as shown in FIGS. 4 and 5, and downwardly toward the downward working position as shown in FIGS. 1–3.

The movement or the forcing of the leg 23 toward or relative to the treadmill frame 20 and the lever 15 may thus be used to easily rotate or to fold the treadmill frame 20 up and down between the upward folding position and the downward working position. The treadmill thus includes a greatly simplified configuration having few members or elements that may be easily manufactured and assembled with greatly lowered cost.

Alternatively, the driving device 3 may be coupled between one of the legs 23 and the lever 15, and thus may also be used to move the leg 23 relative to the treadmill frame 20 and the lever 15 and the supporting surface or ground, and may also be used to rotate or to fold the treadmill frame 20 up and down between the upward folding position and the downward working position.

Accordingly, the treadmill in accordance with the present invention includes an adjusting device for adjusting the treadmill frame up and down between different inclinations, and thus to allow the users to conduct various kinds of walking or jogging exercises, and also for allowing the treadmill frame to be easily folded between the upward folding position and the downward working position with a greatly simplified configuration or structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a base, a treadmill frame including a front portion pivotally secured to said base with a pivot axle, and including a rear portion, a lever including a front portion pivotally secured to said base with a pivot pin, and including a rear portion, a leg including two ends pivotally secured between said rear portion of said treadmill frame and said rear portion of said lever, to form a quadrilateral structure together with said treadmill frame and said lever, and means for driving said leg to rotate relative to said treadmill frame and said lever, and to rotate said treadmill frame and said lever relative to said base between upward folding position and downward working position; wherein said rear portion of said lever includes an elongated slot formed therein to slidably receive said pivot rod of said leg.

2. The treadmill as claimed in claim 1, wherein said leg includes a first end pivotally secured to said rear portion of said treadmill frame with a pivot pin, and a second end pivotally secured to said rear portion of said lever with a pivot rod.

3. The treadmill as claimed in claim 1, wherein said driving means includes a tube attached to a middle portion of said treadmill frame, and an extension slidably engaged in said tube and having a free end pivotally secured to said leg, to force said leg toward and away from said treadmill frame when said extension is slid relative to said tube.

4. The treadmill as claimed in claim 3, wherein said treadmill frame further includes a beam secured to said leg, said free end of said extension is pivotally secured to said leg with a pivot pin.

5. A treadmill comprising:

a base, a treadmill frame including a front portion pivotally secured to said base with a pivot axle, and including a rear portion, a leg including a first end pivotally secured to said rear portion of said treadmill frame with a pivot pin, and including a second end, a lever including a front portion pivotally secured to said base with a pivot pin, and including a rear portion for coupling to said second end of said leg, and means for rotating said leg relative to said treadmill frame, to adjust said leg relative to said treadmill frame to different angular positions; wherein said rear portion of said lever includes an elongated hole formed therein, said second end of said leg includes a pivot rod slidably received in said elongated hole of said lever, said rotating means includes a tube attached to a middle portion of said treadmill frame, and an extension slidably engaged in said tube and having a free end pivotally secured to said leg, to force said leg toward and away from said treadmill frame when said extension is slid relative to said tube.

6. The treadmill as claimed in claim 5, wherein said leg includes a wheel rotatably secured to said second end thereof, to engage with a supporting surface.

* * * * *